US006311507B1

(12) United States Patent
Gameiro

(10) Patent No.: US 6,311,507 B1
(45) Date of Patent: Nov. 6, 2001

(54) REFRIGERATION SYSTEM WITH MINIMUM PRE-SET CONDENSING PRESSURE

(75) Inventor: Walter Gameiro, North Richland Hills, TX (US)

(73) Assignee: Carter Burgess, Incorporated, Fort Worth, TX (US)

( * ) Notice: Subject to any disclaimer, the term of this patent is extended or adjusted under 35 U.S.C. 154(b) by 0 days.

(21) Appl. No.: 09/691,981

(22) Filed: Oct. 19, 2000

(51) Int. Cl.[7] ..... F25B 47/02

(52) U.S. Cl. ..... 62/196.4; 62/222; 62/278; 62/509; 62/513; 62/DIG. 17

(58) Field of Search ..... 62/192, 193, 196.4, 62/509, 504, 512, 470, 277, 278, 81, 84, DIG. 17, 513, 113, 204, 205, 206, 222

(56) References Cited

U.S. PATENT DOCUMENTS 4,566,288 * 1/1986 O'Neal ..... 62/DIG. 17
4,862,702 * 9/1989 O'Neal ..... 62/196.4
5,454,228 * 10/1995 Yang et al. ..... 62/513 X

OTHER PUBLICATIONS

Industrial Refrigeration Handbook by Wilbert F. Stoecker, 9 pages.
Refrigeration 1998 Ashrae Handbook from American Society of Heating, Refrigerating and Air–Conditioning Engineers, Inc., 5 pages.
Thermosyphon Oil Cooling from Frick E 70–900E/Aug. 95, pp. 1–10.

* cited by examiner

*Primary Examiner*—Harry B. Tanner
(74) *Attorney, Agent, or Firm*—Bracewell & Patterson, L.L.P.

(57) ABSTRACT

A refrigeration system comprising a compressor for compressing a refrigerant. The compressor uses an oil for lubrication. A condenser receives the compressed refrigerant and condenses at most of the refrigerant to a liquid. A thermo-siphon vessel receives and stores refrigerant from the condenser. An oil cooler receives liquid refrigerant from the thermo-siphon vessel and uses the liquid refrigerant to cool the compressor oil. An air unit receives liquid refrigerant from the thermo-siphon vessel and uses the liquid refrigerant to cool an enclosure. A receiver receives and stores any overflow liquid refrigerant from the thermo-siphon vessel, vapor and liquid refrigerant from the oil cooler, and releases the overflow back to the air unit as needed. A valve before the receiver restricts the flow of refrigerant from the thermo-siphon vessel to maintain the pressure in the thermo-siphon vessel and receiver above a given point.

19 Claims, 2 Drawing Sheets

REFRIGERATION SYSTEM WITH MINIMUM PRE-SET CONDENSING PRESSURE

TECHNICAL FIELD OF THE INVENTION

This invention relates to refrigeration systems in general, and more specifically, a refrigeration system capable of maintaining a minimum pre-set condensing pressure to produce hot gas for defrosting or heating air units or for use in reheating coils to control relative humidity inside an enclosure, when the ambient conditions around the condenser are very cold.

BACKGROUND OF THE INVENTION

In any conventional refrigeration system, the evaporator or air unit is subject to frosting over when the evaporator temperature is below freezing point. One method of preventing the evaporator from clogging up with frost is to apply an external heat source, such as an electrical heater or water, to the exterior of the air unit which warms it up enough to melt the frost. Another method is to release hot, gaseous refrigerant stored in the receiver of the refrigeration system to the interior of the air unit pipes. Using hot refrigerant from the refrigeration system is preferable to an external heat source, because the hot gas is a by-product of a refrigeration system and an additional energy source is not required.

There are also times when it is desired to warm the enclosure such as when outdoor ambient temperatures are very low. An external heat source, such as an electric heater can be used, but again it is desirable to heat the enclosure using the hot, gaseous refrigerant from the receiver as above. This hot, gaseous refrigerant is routed through hot gas piping either to the air unit in a heating mode or to a separate re-heating coil for heating the enclosure or to control its relative humidity.

However, as the temperature of ambient conditions surrounding a condenser of a refrigeration system sized for the summer conditions begins to drop, the condenser is too large and becomes able to condense the refrigerant at much lower pressures. The pressure of the refrigerant leaving the compressor decreases, and the receiver fills substantially with liquid refrigerant at a lower pressure. In this situation, there is less hot gas refrigerant available, and because the condenser pressure is lower, the available hot gaseous refrigerant is also at a lower pressure and temperature. Many times there is not enough pressure and the gaseous refrigerant is not hot enough to provide ample defrosting to the air unit, to provide heating to the enclosure, or to operate the re-heat coil.

Therefore, there is a need for a refrigeration system that can produce enough hot, gaseous refrigerant at a controlled pressure to defrost air units, operate air units in a heating mode, or operate the re-heat coils, when ambient conditions around the condenser are low.

SUMMARY OF THE INVENTION

The present invention is an improved refrigeration system capable of producing hot gaseous refrigerant at pressures enough to defrost the air unit when the temperature of the ambient conditions around the condenser is low. The system has a compressor for compressing a refrigerant to a hot gaseous refrigerant. The compressor has oil for lubrication. A condenser receives the hot gaseous refrigerant from the compressor and condenses at least a portion of the refrigerant to a liquid refrigerant. A thermo-siphon vessel receives and stores the liquid refrigerant from the condenser. An oil cooler receives the liquid refrigerant from the thermo-siphon vessel and uses the liquid refrigerant to cool the compressor oil. An air unit receives liquid refrigerant from the receiver and uses the liquid refrigerant to cool the enclosure. A receiver receives and stores the liquid refrigerant from the thermo-siphon vessel and releases the liquid refrigerant to the air unit. A pressure regulator between the receiver and the thermo-siphon vessel controls the minimum pressure of the liquid refrigerant from the thermo-siphon vessel. A hot gas line leads from a portion of the system containing hot gaseous refrigerant to the evaporator to defrost the evaporator.

The condenser has an inlet and the upper portion of the receiver is in communication with the inlet for equalizing the pressure of the receiver with the inlet of the condenser. The receiver receives the refrigerant from the oil cooler after cooling the compressor oil. The hot gas line leads from an upper portion of the receiver. The liquid refrigerant is routed to the air unit from the receiver by a liquid line. The liquid line has an inlet positioned above the bottom of the thermo-siphon vessel so as not to completely drain the thermo-siphon vessel when the system runs out of liquid. The pressure regulator opens and closes in response to upstream pressure in this liquid line. If this upstream pressure is below the pressure regulator set point, the liquid flow from the thermo-syphon receiver will stop. That will allow the liquid to flood the condenser. The condenser loses area and increases the discharge pressure of the compressor since the temperature of condensation increases due to the loss of area resulting from flooding. This system allows the pressure at the thermo-syphon receiver to raise and consequently the pressure of the high pressure receiver. The hot gas line coming from the high pressure receiver feeds the air units to raise the temperature of the enclosure and to allow defrost inside as required.

DETAILED DESCRIPTION OF THE INVENTION

Figure 1:
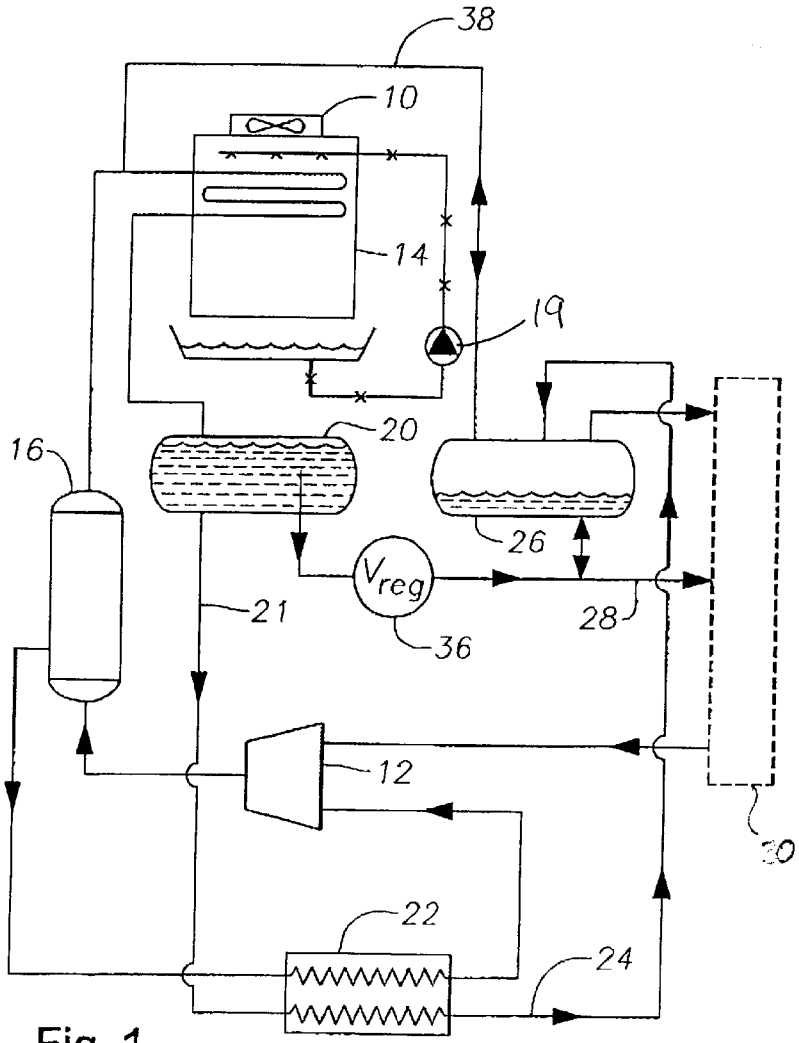
FIG. 1 is a schematic of the improved refrigeration system of this invention.

Referring to FIG. 1, a refrigeration system constructed in accordance with this invention, generally has a compressor 12, which receives and compresses a gaseous refrigerant. Additional compressors can be added if needed. The refrigerant is any refrigerant commonly known to those skilled in the art, including ammonia or a synthetic refrigerant. Compressor 12 receives the refrigerant in a cool gaseous state; however, after compression the refrigerant is in a hotter gaseous state. Compressor 12 is connected to a condenser 14 and releases the gaseous refrigerant through a conduit to an upper inlet in a condenser 14. Compressor 12 is a typical compressor used in refrigeration systems, reciprocating or screw type, which utilizes oil to lubricate and cool its moving parts. Some portion of the oil becomes entrained in the gaseous refrigerant as it is compressed, and is carried toward condenser 14. An oil separator 16 is plumbed between compressor 12 and condenser 14 to remove most entrained oil, and return it to compressor 12.

Condenser 14 is a heat exchanger which receives and cools the compressed refrigerant, condensing substantially most of the gas to a liquid. Condenser 14 may have a fan 10 positioned to create airflow through condenser 14, and a pump 19 to circulate water over the pipes of condenser 14 to evaporate and increase its cooling efficiency. After the refrigerant is condensed to about 95° F. (in warm ambient conditions), it is routed by gravity through a conduit to a thermo-siphon vessel 20 beneath condenser 14.

Thermo-siphon vessel 20 is a vessel that receives the liquid refrigerant. An oil cooler 22 is positioned below vessel 20 and is connected to the bottom of vessel 20 by line 21 to drain liquid refrigerant by gravity, such that the weight of the liquid refrigerant causes it to flow through oil cooler 22. Oil cooler 22 is a heat exchanger that is plumbed between compressor 12 and oil separator 16 to drain and cool oil from separator 16 as it flows back into compressor 12. The saturated liquid refrigerant is routed through oil cooler 22 and used to cool the compressor lubricating oil. Oil cooler 22 is sized such that the cool, liquid refrigerant changes to a gaseous phase as it absorbs heat from the compressor oil and rises up a return line 24 to a receiver 26. Return line enters at the top of receiver 26. Since oil cooler 22 is gravity fed, the height distance between thermo-siphon vessel 20, receiver 26 and oil cooler 22 is selected to compensate for the head loss in the oil cooler 22 and related plumbing.

Figure 2:
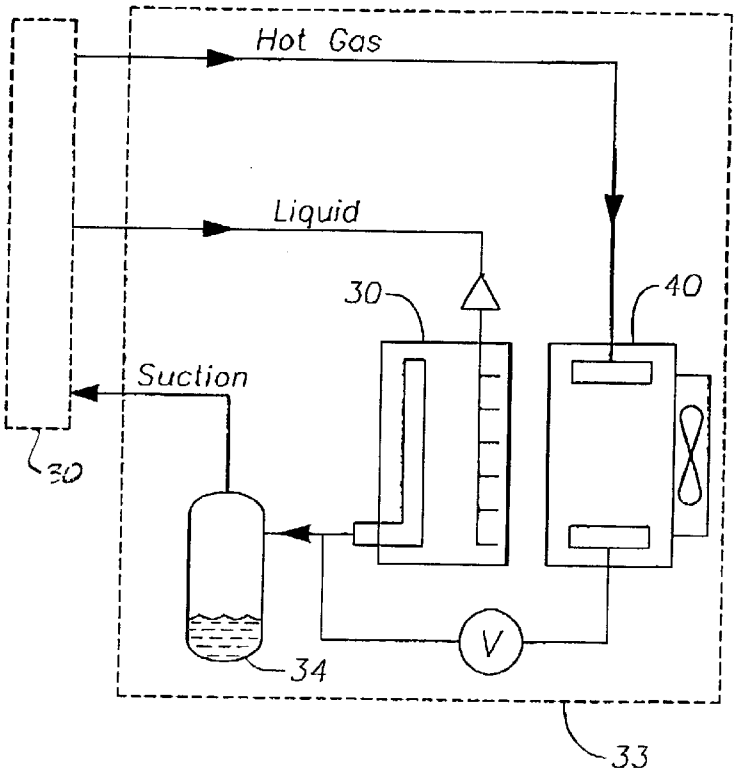
FIG. 2 is a schematic of the low side of the improved refrigeration system of FIG. 1 configured as a direct expansion system.

A liquid line 28 originates in thermo-siphon vessel 20 to route liquid refrigerant from vessel 20 to an air unit heat exchanger 30 as part of what will, for convenience, be referred to as a low side system. The low side system is generally the portion of the refrigeration system which accepts refrigerant, either in a gaseous or liquid form, from condenser 14 to heat or cool an enclosure 33 (FIG. 2). The low side system can be a direct expansion system, a flooded system, or an overfeed system, and will be discussed in more detail below.

The inlet of liquid line 28 is positioned above the bottom of thermo-siphon vessel 20 and above the outlet to line 21 to pick up liquid only when the liquid level is above a given level. When the liquid level reaches or drops below that level, it drops below the inlet of liquid line 28 and line 28 cannot pick up any more liquid. The height of the liquid line 28 inlet is chosen such that enough liquid refrigerant remains to flow through line 21 to run oil cooler 22 for an additional period of time, preferably five minutes, after the liquid line 28 stops picking up liquid.

Receiver 26 is plumbed to add additional liquid refrigerant to liquid line 28 as needed or act as a surge storage vessel when more liquid refrigerant than is needed is produced from condenser 14. Unlike prior art systems where the thermo-siphon vessel overflows into the receiver, then liquid is routed from the receiver to the air unit, liquid line 28 flows directly from thermo-siphon vessel 20 to air unit 30. Receiver 26 is positioned above line 28 to separate any vapor that did not condense and is mixed with liquid in line 28. Also, at least a portion of receiver 26 is above the outlet of thermo-siphon vessel 20 to liquid line 28. When there is more liquid refrigerant than is needed, the liquid refrigerant can back up into receiver 26. Also, receiver 26 receives refrigerant vapor returning from oil cooler 22. This allows the liquid to rise through the thermo-syphon receiver 20 up to condenser 14 without impairing the performance of coil cooler 22.

Figure 4:
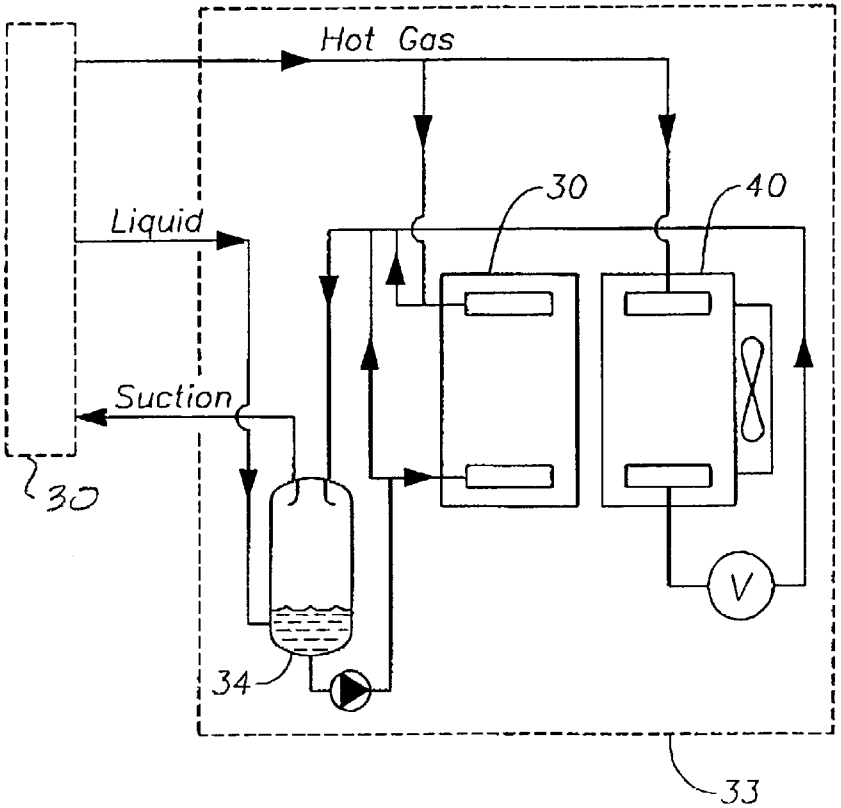
FIG. 4 is a schematic of the low side of the improved refrigeration system of FIG. 1 configured as a liquid overfeed system.
Figure 3:
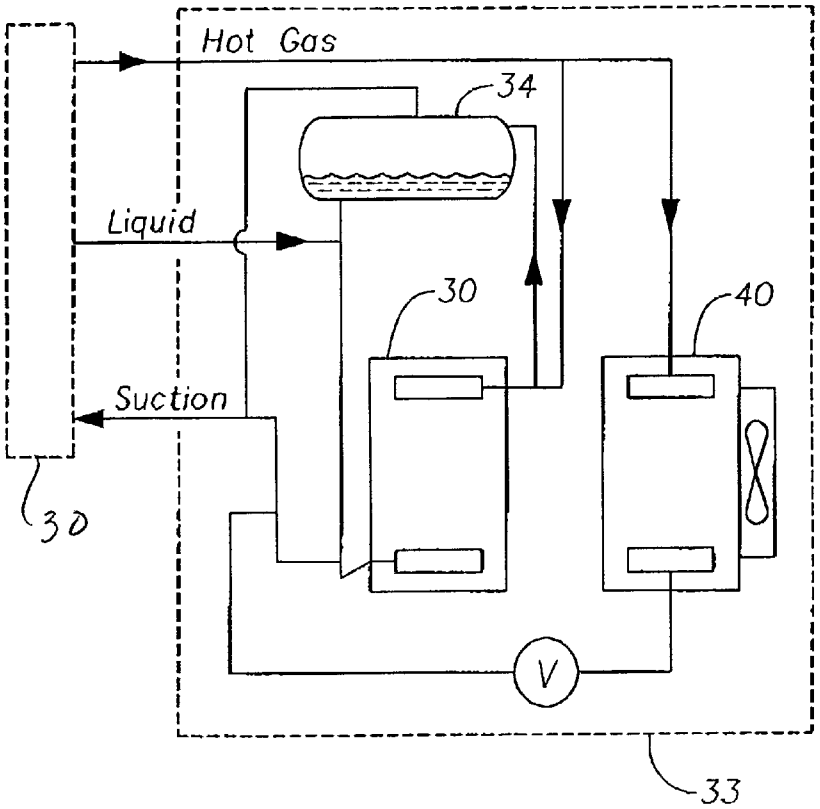
FIG. 3 is a schematic of the low side of the improved refrigeration system of FIG. 1 configured as a flooded system.

Referring generally FIGS. 2–4, the low side system can be configured in a variety of ways known to those skilled in the art, including as a direct expansion system (FIG. 2), a flooded system (FIG. 3), or a liquid overfeed system (FIG. 4). In each configuration, air unit 30 is a heat exchanger which uses the liquid refrigerant to cool airflow from fan 32. The air is then used to cool an enclosure 33, such as a cooler or freezer. Alternatively, the liquid flow into air unit 30 can be blocked, and hot gas can be flowed through air unit 30 to heat enclosure 33. In a direct expansion system (FIG. 2) used to cool enclosure 33, liquid refrigerant from liquid line 28 is routed directly into air unit 30. The higher pressure liquid enters at the top of air unit 30 and is drawn out the bottom. The liquid refrigerant warms in air unit 30, changes to a gaseous state, and is routed back to compressor 12 through an accumulator 34 included to equalize the flow through air unit 30. If air unit 30 is operated near or below the freezing temperature of water, frost will form on its exterior. To defrost air unit 30, the flow of liquid refrigerant in to air unit 30 is ceased, and hot, gaseous refrigerant is routed from receiver 26 through air unit 30 to melt the frost. The hot, gaseous refrigerant cools in air unit 30 and is routed back to compressor 12 through accumulator 34.

To control relative humidity in enclosure 33, air unit 30 can be combined with a re-heating coil 40, which uses the hot gaseous refrigerant to re-heat airflow cooled by air unit 30. The airflow is cooled below the desired enclosure temperature to dry the air, and then re-heated to the desired temperature. The hot gaseous refrigerant used in re-heat coil 40 condenses to a liquid and is routed through an accumulator where it is separated from vapor, and the vapor is routed to compressor 12. One skilled in the art will appreciate that the configuration depicted in FIG. 2 can be configured without re-heat coil 40, simply by removing coil 40 and associated plumbing.

A flooded system, shown in FIG. 3, is similar to the direct expansion system described above, except that the liquid refrigerant enters the bottom of air unit 30 and accumulator 34 is positioned above. As liquid refrigerant receives heat in air unit 30, it changes to a gaseous phase. Refrigerant vapor is separated from the gaseous refrigerant in accumulator 34, and accumulator 34 is plumbed to act as a surge tank for air unit 30 to receive excess refrigerant and feed additional liquid refrigerant when needed. A liquid overfeed system, shown in FIG. 4, also routes the liquid refrigerant into the bottom of air unit 30; however, accumulator 34 is plumbed to recycle vapor separated from the warmed refrigerant after exiting air unit 30. Each of these systems can be configured with or without a re-heat coil 40, though are depicted in FIGS. 3 and 4 with re-heat coil 40.

At times when the ambient air is cold, condenser 14, being sized for warmer temperatures, is oversized and too efficient, and thus is capable of condensing refrigerant at much lower pressure than normal. The pressure of the refrigerant supplied from compressor 12 drops substantially. A valve or pressure regulator 36 is plumbed between thermo-siphon vessel 20 and receiver 26 to close when the upstream pressure of the refrigerant drops below a given point. This backs liquid refrigerant up into condenser 14, flooding the lower portions of condenser 14, and effectively reduces the heat transfer area of condenser 14. Reducing the heat transfer area reduces the efficiency of condenser 14, and thus causes the pressure at the inlet of condenser 14 to increase and pressure regulator 36 to eventually re-open. It is important to note that when pressure regulator 36 backs liquid refrigerant into condenser 14, less liquid refrigerant is supplied to receiver 26 from vessel 20, thus leaving receiver 26 available to act as a surge storage vessel. An equalizing line 38 runs between the inlet of condenser 14 and receiver 26 to substantially equalize the pressure between the vessel 20 and receiver 26. The only difference in pressure is due to the corresponding column of liquid backed up to the condenser.

Generally in this system, liquid refrigerant takes up only a small portion of receiver 26, unlike traditional receiver systems, while the remainder is hot, saturated gas received by the two phase separation and through equalizing line 38. This hot gaseous refrigerant is taken from the top of receiver 26 and fed as needed to the interior of air unit 30 to defrost air unit 30 when it accumulates enough frost. Additionally, the hot, gaseous refrigerant can be routed to a re-heat coil 40 in enclosure 33 or to air unit 30 to heat enclosure 33 and maintain it at a temperature lower than the air unit 30, but higher than the winter outdoor ambient conditions. Thus, an additional heating element is not required to defrost air unit 30, or to heat it up and warm enclosure 33 or even to re-heat air and achieve relative humidity control in enclosure 33. Pressure regulator 36 is set to maintain the pressure in condenser 14, and thus receiver 26, at a high enough pressure to provide an adequate supply of hot, gaseous refrigerant for the different applications and applicable to any refrigeration system, such as direct expansion, flooded, liquid overfeed, or controlled pressure gas (not shown), known as CPR.

This system has many significant advantages. Because the receiver requires a smaller amount of refrigerant to operate, it only has a small volume of liquid refrigerant. Less refrigerant, results in less expense and more safety in that there is less refrigerant to escape if a leak develops, particularly when one employs ammonia, butane or carbon dioxide. In winter, when the condenser is very efficient, the pressure regulator causes refrigerant to back up into the condenser and reduce its efficiency without flooding the receiver, which would impair the performance of the oil cooler or coolers. Once one sets up the pressure regulator, the discharge pressure will never fall below that setting, which keeps the discharge pressure throughout winter high enough to maintain an ample supply of hot gaseous refrigerant at high enough pressures to defrost air units, to add heat to an enclosure, or still to employ re-heat techniques. Also, the gas in the receiver is de-superheated and thus not too hot to use in defrost where the contact with cold liquids may cause condensing enhanced hydraulic shocks.

While the invention has been shown in only one of its forms, it should be apparent to those skilled in the art that it is not so limited, but is susceptible to various changes and modifications without departing from the spirit thereof.

I claim:

1. A refrigeration system for cooling an enclosure, comprising:

a compressor for compressing low pressure vapor refrigerant to a high pressure and hot vapor refrigerant, the compressor having an oil for lubrication, a condenser for receiving the hot vapor refrigerant from the compressor and condensing the hot vapor refrigerant to a liquid refrigerant;

a thermo-siphon vessel for receiving and storing the liquid refrigerant from the condenser;

an oil cooler for receiving the liquid refrigerant from the thermo-siphon vessel and using the liquid refrigerant to cool the compressor oil by changing the liquid refrigerant back to a vapor refrigerant;

a receiver for receiving and storing the liquid refrigerant from the thermo-siphon vessel, receiving the vapor refrigerant from the oil cooler and releasing the liquid refrigerant to the air unit;

an air unit for receiving the liquid refrigerant from the thermo-siphon vessel and the receiver and using the liquid refrigerant to cool the enclosure;

a valve between the receiver and the thermo-siphon vessel for restricting the flow of the liquid refrigerant from the thermo-siphon vessel; and a hot gas line leading from the receiver to the air unit to for supplying vapor refrigerant contained therein to the air unit to defrost the air unit.

2. The refrigeration system of claim 1 wherein the condenser has an inlet and an upper portion of the receiver is in communication with the inlet for equalizing the pressure of the receiver with the inlet of the condenser.

3. The refrigeration system of claim 1 wherein the receiver receives the refrigerant from the oil cooler after cooling the compressor oil.

4. The refrigeration system of claim 1 wherein the hot gas line leads from an upper portion of the receiver.

5. The refrigeration system of claim 1 wherein the liquid refrigerant is routed to the air unit from the thermo-siphon vessel and the receiver by a liquid line, and the liquid line has an inlet positioned above a bottom of the thermo-siphon vessel so as not to completely drain the thermo-siphon vessel.

6. The refrigeration system of claim 1 wherein the valve opens and closes in response to upstream pressure.

7. The refrigeration system of claim 1 further comprising a heat exchanger for receiving the vapor refrigerant from the receiver and using the vapor refrigerant to heat its surroundings.

8. A refrigeration apparatus comprising:

a compressor for compressing a low pressure vapor refrigerant to a high pressure and hot vapor refrigerant, the compressor being lubricated by an oil;

a condenser having an inlet for receiving the hot vapor refrigerant from the compressor and condensing the vapor refrigerant to a liquid refrigerant;

a thermo-siphon vessel having an inlet for receiving and storing the liquid refrigerant from the condenser, an oil cooler outlet leading to the oil cooler to cool the oil, and a liquid line outlet leading to a liquid line;

an air unit having an inlet connected to the liquid line for receiving the liquid refrigerant to cool an area;

a liquid line leading from the thermo-siphon vessel to the air unit for flowing liquid refrigerant to the air unit;

a receiver having a lower line connected to the liquid line for receiving any overflow liquid refrigerant from the thermo-siphon vessel and releasing the overflow liquid refrigerant back through the lower line into the liquid line as needed, the receiver having a pressure equalizing line leading from an upper portion of the receiver to the inlet of the condenser;

an oil cooler for receiving the liquid refrigerant from the thermo-syphon vessel for cooling the oil by changing the liquid refrigerant into a vapor refrigerant;

the receiver receiving the vapor refrigerant from the oil cooler and having a hot gas line leading from an upper portion of the receiver to the air unit to deliver the vapor refrigerant contained therein to the air unit to defrost the air unit, as needed; and a valve in the liquid line between the thermo-siphon vessel and the receiver to restrict the flow of refrigerant from the thermo-siphon vessel into the liquid line, thereby selectively causing a portion of the condenser to flood, the valve being actuated in response to upstream pressure.

9. The apparatus of claim 8 wherein the liquid line outlet is positioned above a bottom of the thermo-siphon vessel so as not to completely drain the thermo-siphon vessel.

10. The apparatus of claim 8 wherein at least a portion of the receiver is at a higher elevation than the liquid line outlet of the thermo-siphon vessel.

11. The apparatus of claim 8 wherein the lower line of the receiver leads from a bottom portion of the receiver.

12. The apparatus of claim 8 wherein the liquid refrigerant flows by gravity from the thermo-siphon vessel to the liquid line.

13. A method of refrigerating an area, comprising the steps of:

(a) compressing a low pressure vapor refrigerant to a high pressure and hot vapor refrigerant with a compressor;

(b) condensing at least a portion of the hot vapor refrigerant to a liquid refrigerant with a condenser;

(c) flowing the liquid refrigerant to a thermo-siphon vessel;

(d) flowing a portion of the liquid refrigerant from the thermo-siphon vessel through an air unit to extract heat from the area;

(e) flowing a portion of the liquid refrigerant from the thermo-siphon vessel to an oil cooler to cool a lubricating oil of the compressor, by changing the liquid refrigerant in the oil cooler to a vapor refrigerant;

(f) receiving any overflow portions of the liquid refrigerant from the thermo-siphon vessel in a receiver and flowing the liquid refrigerant from the receiver to the air unit as needed;

(g) controlling the flow of the liquid refrigerant from the thermo-siphon vessel to the receiver in response to upstream pressure; and (h) flowing a portion of the vapor refrigerant from the oil cooler to a given location and using the vapor refrigerant from the oil cooler as a heat source.

14. The method of claim 13 wherein the vapor refrigerant leaving the oil cooler is first delivered to the receiver, and wherein step (h) comprises flowing the vapor refrigerant from the receiver to the given location.

15. The method of claim 14 further wherein step (h) comprises restricting the flow of liquid refrigerant from the thermo-siphon vessel until a portion of the condenser floods with the liquid refrigerant, thereby reducing the efficiency of the condenser.

16. The method of claim 15 wherein the step (h) comprises flowing a portion of the vapor refrigerant to the air unit to defrost the air unit.

17. The method of claim 15 wherein step (h) comprises connecting a line from an upper portion of the receiver to the air unit.

18. The method of claim 15 wherein step (h) comprises flowing a portion of the vapor refrigerant to a second heat exchanger to heat the area.

19. The method of claim 15 further comprising the step of equalizing pressure in the receiver with an inlet to the condenser.

* * * * *